United States Patent [19]

Evans

[11] Patent Number: 4,572,513

[45] Date of Patent: Feb. 25, 1986

[54] EDUCATIONAL GAME HAVING PRE-RECORDED QUESTIONS AND ANSWERS

[75] Inventor: R. Evan Evans, Largo, Fla.

[73] Assignee: Eva-Tone Soundsheets, Inc., Clearwater, Fla.

[21] Appl. No.: 520,947

[22] Filed: Aug. 8, 1983

[51] Int. Cl.[4] ..... A63F 3/00

[52] U.S. Cl. ..... 273/242; 434/308

[58] Field of Search ..... 273/242, 243, 249, 302; 434/308, 318, 157, 319, 320, 321

[56] References Cited

U.S. PATENT DOCUMENTS

| | | | |
|---|---|---|---|
| 779,229 | 1/1905 | Mansfield | 273/249 |
| 1,517,847 | 3/1924 | Llera et al. | 273/249 |
| 1,635,734 | 11/1927 | Ziegler | 273/249 |
| 3,292,276 | 12/1966 | Hansel | 434/308 |
| 3,510,966 | 5/1970 | Golden et al. | 434/318 |
| 3,575,417 | 4/1971 | Sylvester | 273/249 |
| 3,808,707 | 7/1974 | Fink | 434/252 |
| 3,831,946 | 5/1974 | Denalsky | 273/249 |
| 3,888,025 | 6/1975 | Schneider | 434/157 |
| 4,029,320 | 7/1977 | Hausman | 273/249 |
| 4,090,717 | 4/1978 | Rossetti | 273/249 |

*Primary Examiner*—Richard C. Pinkham
*Assistant Examiner*—Matthew L. Schneider
*Attorney, Agent, or Firm*—Geoffrey R. Myers

[57] ABSTRACT

An educational game including a game board, at least one game piece and an audio recording. The game board has a serpentine path located on the top face thereof. The serpentine path is broken up into a series of connected squares. The game piece is designed such that it is moved along the path as the game is played. The audio recording contains a number of mathematical problems or other questions and the answers thereto. Each question or problem is separated from its answer by a pause of predetermined duration. Each time the player of the game answers a problem or a question correctly and within the time allowed, the player advances his/her game piece along the serpentine path. The number of squares on the path and the number of questions on the recording are equal so that if a player answers all of the questions correctly, his/her game piece exactly reaches the finish space.

1 Claim, 3 Drawing Figures

EDUCATIONAL GAME HAVING PRE-RECORDED QUESTIONS AND ANSWERS

This invention relates to educational games and methods of playing the same. More particularly, this invention relates to educational games and methods for teaching children how to effect "quick-recall" solutions to problems, especially of a mathematical nature.

BACKGROUND OF THE INVENTION

There have been and still are many devices for and many methods of aiding children in memorizing solutions to simple problems such as the multiplication tables or naming the capital cities of the fifty states. Such devices include flash cards, work books, puzzles, etc. Often these devices require the involvement of two or more people, thus placing a limitation on their use.

In addition, many methods have been used to aid a child in memorizing mathematical solutions and/or factual relationships, including competitive games involving the determination of who between two or more students can first give the solution to a mathematical problem, or answer a question. Other methods include visual and audio recognition methods such as used on various children's shows. These methods can include songs, animated figures or costumed characters performing some act that will help a child memorize the solutions to mathematical problems or other factual relationships.

Regardless of the number of prior art devices and methods for teaching children the solutions to various problems or in memorizing various factual relationships and the effectiveness of the same, teachers and parents are always searching for new devices and methods to aid the student. This is not necessarily due to the inadequacy of the prior art, but rather it is because the employment of a variety of devices or methods is preferable in order to capture the otherwise short attention span of a child. Moreover, different games or methods will have different impacts on different children. It is virtually impossible to forecast which device or method will most appeal to a particular child. Therefore, it is best to have at one's disposal a variety of methods or devices for teaching children.

As an example of the above, competitive children may memorize solutions to mathematical problems or factual relationships more quickly if the learning involves a competitive feature, while the same competitive feature may inhibit the learning of a quiet withdrawn child. The reverse may be true if the same two types of children are exposed to a learning device or method involving cartoon characters.

Thus, from the above, it can be seen that there is always a need in the art for an effective educational device or method for aiding children in the memorizing or "quick recall" of solutions to mathematical problems or other factual relationships.

SUMMARY OF THE INVENTION

This invention fulfills this need in the art by providing an educational game comprising a game board having a top face; a game piece; and an audio recording, said top face having a path thereon comprised of a series of squares; said game piece being designed and arranged such that it can be picked up and moved by a child and such that it can be set within the outlined of each of said squares; said audio recording having a number of questions and answers to said questions recorded thereon; each of said questions being followed by said answer to said question on said audio recording.

In some embodiments of this invention, the audio recording contains a predetermined time-delay or pause between each of the questions and each of the answers. The pause is provided so that the player of the game has the opportunity to properly orally respond to the question before the audio recording states the answer. If the player correctly orally answers the question within the time allowed, the player may advance his/her game piece along the path of squares.

In other embodiments, the number of squares in the path equals the number of questions and answers given on one side of the audio recording, such that if the player answers all the questions correctly and within the proper time, and if he/she moves his/her game piece one square each time he/she gives a correct answer, the player will move his/her game piece the entire length of the path of squares and win the game.

To appeal to children so as to captivate their attention, an esthetic scene may be imprinted or affixed onto the top face of the game board. The path of squares may wind through the esthetic scene so that the child or children playing the game will focus their attention on the game board.

This educational game and method have the advantages that it can be played by one or more children at a time, is easily set up, requires minimum supervision, is self-instructive, and can be played many times. Furthermore, the same game board can be employed with a number of different recordings containing different questions and questions of different degrees of difficulty for a child as the child progresses, or for children of different ages and skill levels in the same family, class or neighborhood.

This invention will now be described with respect to certain embodiments as illustrated in the accompanying drawings wherein:

IN THE DRAWINGS

DETAILED DESCRIPTION OF THE DRAWINGS

Figure 1:
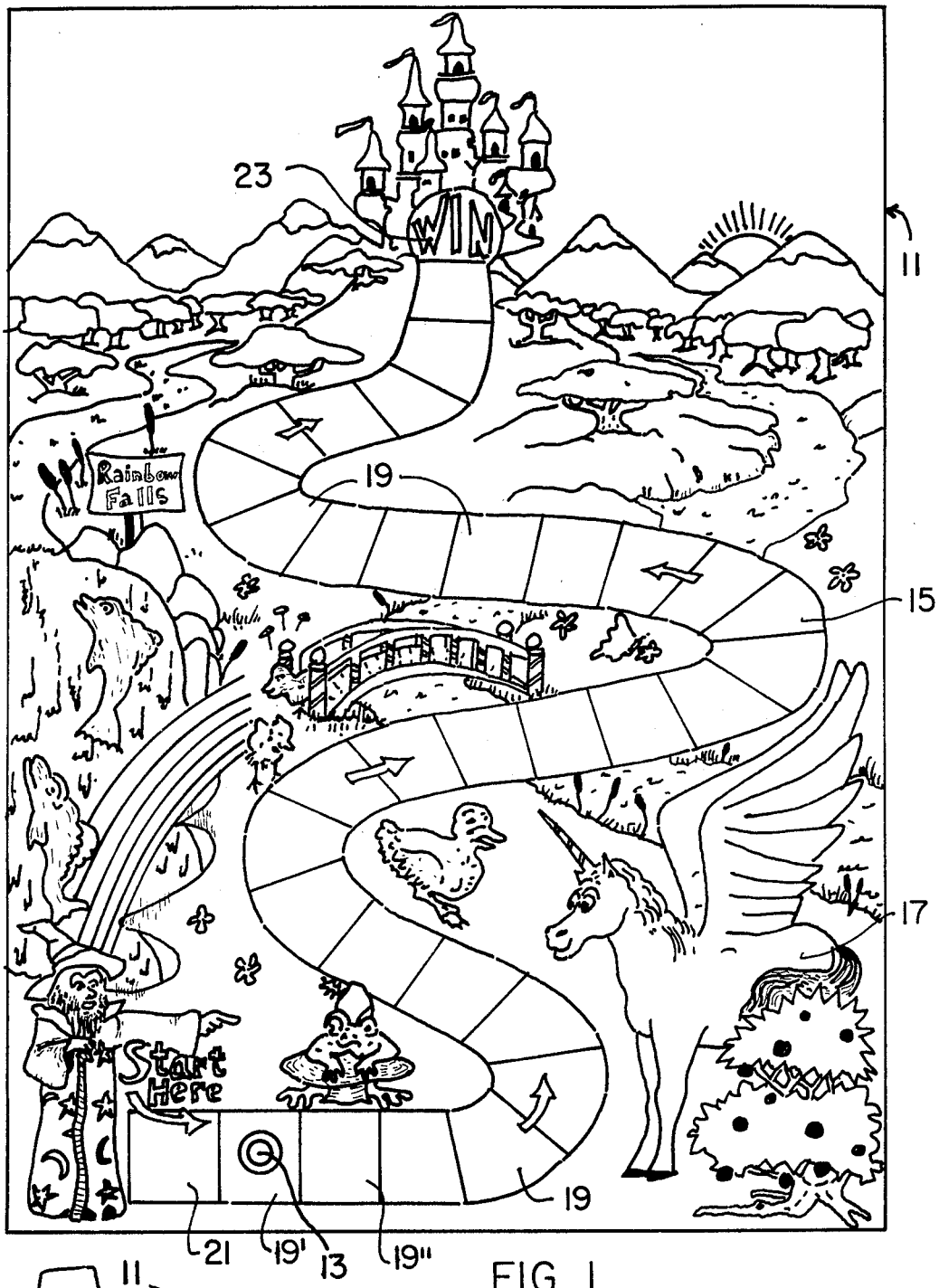
FIG. 1 is a top view of one embodiment of the game board with a game piece placed thereon.

Referring to the Figures, an embodiment of this invention is illustrated which includes game board 11, game playing piece 13 and an audio recording (not shown), such as a phonograph.

Game board 11 is of conventional construction having a card board or other material backing which has provided on its surface a serpentine path 15 and esthetically pleasing drawing imprinted on a sheet of paper which is then glued thereon or otherwise affixed to top face 17 of game board 11.

Serpentine path 15 is broken up into a series of squares 19 which extend from starting square 21 to "win" square 23. Path 15 may take other forms or shapes if so desired.

The rest of top face 17 of game board 11 can be comprised of a drawing of any type of scene through which serpentine path 15 winds. One example of such a scene is a path leading up to a castle located on top of a hill, as shown in FIG. 1. The path can wind through a country setting by and through green pastures, domestic or wild animals, trees, streams, etc. In other embodiments, the faces of cartoon characters or other imaginary figurines could be included on top face 17. The important feature of the drawing should be that it is appealing to children learning mathematics or the type of "quick-recall" subject matter being taught.

Figure 2:
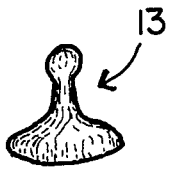
FIG. 2 is a perspective view of a typical game piece useful in this invention.

Game piece 13, shown in FIG. 2, is just one example of a whole magnitude of game pieces which could be employed in playing this game. Game pieces 13 can be of any shape or size, as long they can sit on the game board within the outline of each square and can be picked up and moved by children playing the game.

Figure 3:
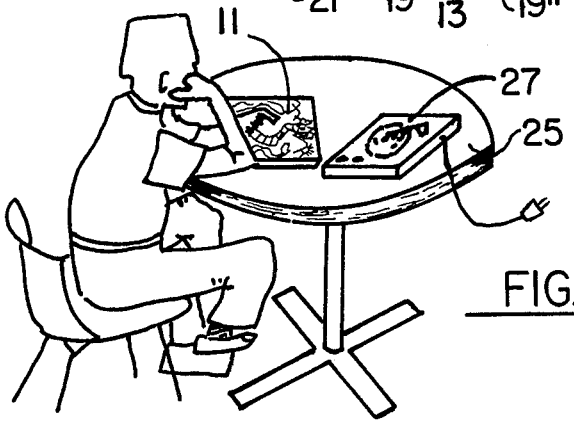
FIG. 3 is a perspective view of a child playing the game.

FIG. 3 illustrates a child sitting at table 25 and playing an embodiment of this invention. The child sits with his attention focused on game board 11 which is resting on table 25 while he listens to the phonograph play in phonograph player 27. The child moves his/her game piece 13 along serpentine path 15 as he/she plays the game.

The particular phonograph (not shown) used in phonograph player 27 has recorded thereon a set of instructions and a series of questions and answers, for example, mathematical problems and solutions. The set of instructions are heard first as the phonograph is played, followed by the series of mathematical problems. The mathematical problems are recorded on the phonograph such that the problem is stated orally and then there is a predetermined time delay or pause before the answer to the problem is given, for example, "two plus two equals . . . (3 sec. delay) . . . four". The exact time delay chosen will be tailored to the skill level being addressed and the complexity of the problem posed.

This invention is not limited to the questions and answers being recorded on a phonograph only. Rather, the phonograph can be replaced by a cassette tape, audio disc or any other type of audio recording, as desired.

The method of playing the embodiment of this invention illustrated in the Figures is as follows:

First the player takes game board 11 and sets it on table 25 (or on any other playing surface such as a bed or a floor) with at least one game piece 13. The player then takes the phonograph (or other audio recording) containing the instructions and problems and places it on phonograph player 27, or other type of audio player, depending on the type of audio recording employed. When the child is ready to begin playing, he/she turns phonograph player 27 on.

The child then listens to the instructions given on the phonograph and prepares to begin the game with game piece 13 in start square 21. The phonograph will then recite a problem such as "two plus two equals", or "the capital of Maryland is" and then there will be the aforesaid audio pause in the phonograph. The child playing the game then has time during the pause to solve the problem and orally recite the answer to the problem.

After the pause, the phonograph recites the answer to the problem. If the child answered the problem correctly and before the answer was given by the phonograph, then the child is allowed, by the rules of the game, to advance his/her game piece 13. In the embodiment of this invention illustrated in the Figures, the player advances his/her game piece 13 one square. If the child failed to answer the question correctly or within the time allowed, his/her game piece 13 remains where it is.

This can be illustrated by looking at FIG. 1. Assuming that the child's game piece is piece 13 sitting on square 19' before the problem is asked by the phonograph. If the chiled answers the problem correctly and before the answer is given on the phonograph, then the child should move piece 13 to square 19''. If the child incorrectly answers the problem or fails to give the correct answer before the phonograph gives the answer, then the child's piece 13 should remain in square 19'. By the end of each game the child's progress can be measured by how far he/she has advanced along path 15.

In addition to the pause or time-delay between each question and answer, there will also be provided an additional time delay between a new question and the previous answer. This span of this additional delay will also be determined by the level skill being addressed and the degree of complexity of the problems.

In some embodiments of this invention, the number of problems on the tape equals the number of squares 19 in serpentine path 15. In these embodiments, if the player answers all the problems correctly and within the time allowed, then that player's game piece 13 will end up in "win" square 23. If the player gives one or more incorrect answers and/or fails to answer one of the problems within the time of one of the pauses during the playing of the game, then that player will not reach "win" square 23 with his/her game piece 13.

As can be seen, the game can be played by one or more children at once. If a child is playing alone, then the challenge to that child is to answer each question correctly and within the time allowed so that he/she reaches the win square 23 with his/her game piece 13. If the child fails to do so, he/she is faced with a challenge to keep playing the game until he/she is able to reach the win square 23 with his/her game piece 13.

If two or more children are playing, the winner of the game may be defined as that child whose game piece is fartherest (has moved the most squares) along path 15 when all the questions have been posed by the audio recording. The child or children who did not win the game will be challenged to study their mathematics or other factual relationships which are on the audio recordings so that he/she will win the game the next time it is played by the children.

Another feature of this game is that a single game board 11 and a game piece 13 can be employed with a number of audio recordings. Any number of audio recordings containing questions and answers can be employed in this game. In fact, it is preferable to have a number of recordings so that the difficulty of the questions can be increased as the child matures, and also so that a wide variety of questions can be posed to the player of the game. Furthermore, having recordings of varying difficulty, enables children of different ages and abilities in the same family or neighborhood to play with the game.

Once given the above disclosure, many other embodiments, modifications and improvements will become apparent to the skilled artisan. These embodiments, modifications and improvements are considered to come within the scope of this invention, as defined by the following claims.

I claim:

1. An educational game comprising:

a game board having a top face;

a game piece; and an audio recording, said top face having a path thereon comprised of a series of connected squares;

said game piece being designed and arranged such that it can be picked up and moved by a child and such that it can be set within the outlines of each of said squares, said audio recording having a number of questions and answers to said questions recorded thereon, each of said questions being followed by said answer to said question on said audio recording;

wherein said questions and said answers are recorded on one side of the audio recording; and wherein there are the same number of said squares as there are number of said questions recorded on said one side of the audio recording.

* * * * *